United States Patent [19]

Mattei et al.

[11] 3,951,566

[45] Apr. 20, 1976

[54] AXIAL-FLOW FAN WITH BY-PASS PIPE OR PIPES

[75] Inventors: Jean Mattei, Saint-Mande; Bernard Simon, Clamart; Ingrid Vuong nee Adlerberg, Bures-sur-Yvette, all of France

[73] Assignee: Electricite de France (Service National), Paris, France

[22] Filed: Dec. 11, 1974

[21] Appl. No.: 531,714

[30] Foreign Application Priority Data

Dec. 11, 1973 France ..... 73.44198
Nov. 21, 1974 France ..... 74.38270

[52] U.S. Cl. ..... 415/115; 415/144; 415/119

[51] Int. Cl.[2] ..... F04D 29/66

[58] Field of Search ..... 415/115, 144, DIG. 1, 415/119

[56] References Cited

UNITED STATES PATENTS

| | | | |
|---|---|---|---|
| 2,037,940 | 4/1936 | Stalker | 415/DIG. 1 |
| 2,720,356 | 10/1955 | Erwin | 415/115 |
| 3,365,172 | 1/1968 | McDonough et al. | 415/DIG. 1 |
| 3,484,039 | 12/1969 | Mittelstaedt | 415/144 |
| 3,690,786 | 9/1972 | Silvestri, Jr. | 415/DIG. 1 |
| 3,730,639 | 5/1973 | Moore et al. | 415/DIG. 1 |
| 3,846,038 | 11/1974 | Carriere | 415/DIG. 1 |

FOREIGN PATENTS OR APPLICATIONS

| | | | |
|---|---|---|---|
| 799,675 | 8/1958 | United Kingdom | 415/DIG. 1 |

*Primary Examiner*—Henry F. Raduazo
*Attorney, Agent, or Firm*—Ostrolenk, Faber, Gerb & Soffen

[57] ABSTRACT

In a method of widening the zone of stable operation of an axial-flow fan, and of attenuating noise generated thereby, a portion of the flow medium is drawn off upstream of the fan and is returned to a zone at the periphery of the fan rotor. The invention also includes an axial-flow fan for carrying out the method.

3 Claims, 2 Drawing Figures

AXIAL-FLOW FAN WITH BY-PASS PIPE OR PIPES

BACKGROUND OF THE INVENTION

1. Field Of The Invention

This invention relates to a method of improving the operation of an axial-flow fan, and to an improved axial-flow fan, and to an improved axial-flow fan.

2. Description Of The Prior Art

It is known that operation of an axial-flow fan has a tendency to become unstable, when the flow is reduced from a normal operational level by reason of turbulence in the passage of medium around the rotor blades of the fan.

It is also known that an axial-flow fan generates a pure sound in the form of a siren-like noise, at a frequency proportional on the one hand to the speed of rotation of the fan and moreover to the number of its blades. The result is an acoustic nuisance which is manifest for example in power stations and in aircraft jet propulsion units which have such fans.

Attempts have been made to reduce this nuisance by adopting one or more of the following:

addition of a silencer upstream and/or downstream of the fan;

disposition of a hood around the fan;

addition of an internally honeycombed envelope at the level of the rotor;

provision of resonators upstream of the rotor;

disposition of a grille upstream of the fan; this requires over-dimensioning of the fan.

It will be appreciated that these prior devices have disadvantages, particularly in that they involve bulky equipment and reduce fan efficiency.

French Pat. No. 1,505,043 discloses extension of the stable operating zone of a compressor or of an axial blower, and Swiss Pat. No. 437,614 discloses a reduction in noise in an axial-flow fan. These two prior Patents provide for use of an additional flow to modify turbulence in the flow of medium in the region of the fan blades, and the means used to create this additional flow comprise slots or channels in the blades, the slots or channels not being at the same time supplied with medium drawn off upstream of the fan and adapted to convey the medium to the periphery of the blades. On the contrary, if one examines FIG. 5 of the Swiss Patent, it would appear that drawing-off of additional medium through the pipe 15 occurs not only upstream but downstream of the rotor.

SUMMARY OF THE INVENTION

It is an object of the invention to widen the zone of aerodynamic operating stability of an axial-flow fan and to attenuate noise, particularly pure sound, created by the fan.

We have found that there is a correlation between the absolute level of the noise and the emergence of the pure sound generated, on the one hand, and turbulence in the flow at the fan blade level, on the other.

In general, extension of the zone of operational stability of the fan and attenuation of its noise, resides in modifying the turbulence in the flow of medium at the zone of the rotor blades of the fan, by the addition of a peripheral flow of medium at the zone of the blades.

According to this invention there is provided a method of improving the operation of an axial-flow fan, by widening the zone of operation of stability thereof and/or by attenuating the noise generated thereby, characterised in that upstream of a fan rotor, a fraction of the flow medium is drawn off and passed to a zone at the periphery of the rotor. Preferably, withdrawal of flow medium takes place in pulsating manner at a frequency proportional to the speed of rotation of the fan rotor and to the number of its blades.

Also according to this invention, in an axial-flow fan comprising a fan casing and a rotor having blades, the casing having a flow zone upstream of the rotor, the improvement is provided wherein at least one pipe is provided for drawing off flow medium from the said flow zone and passing the drawn off medium to a second zone at the periphery of the rotor.

Thus by means of the invention it is possible to achieve an extension of the zone of operating stability and attenuation of noise, particularly pure sound, without substantially altering aerodynamic performance of the fan.

DESCRIPTION OF THE PREFERRED EMBODIMENT

Figure 1:
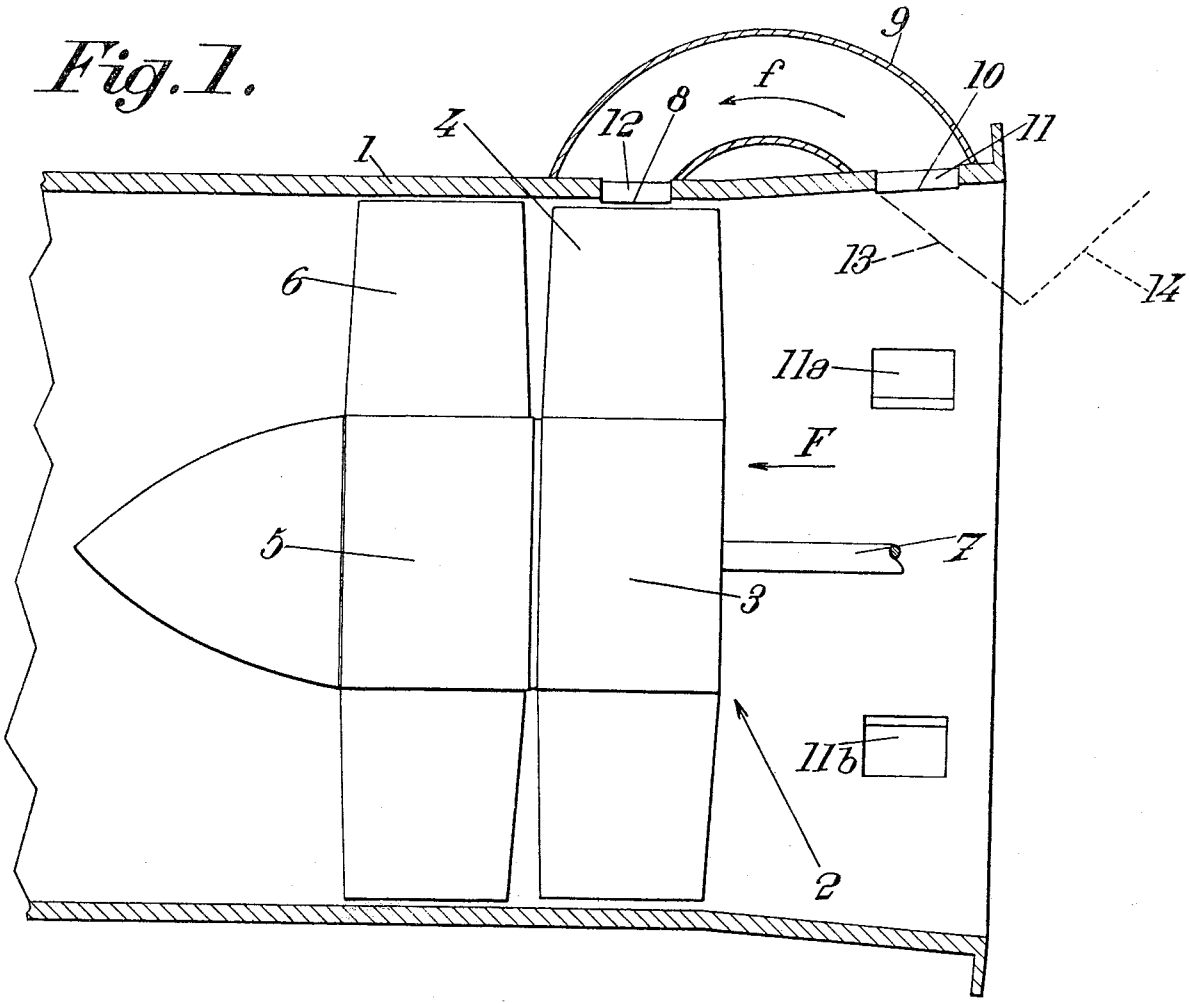
FIG. 1 is an axial longitudinal section of a fan in a conduit.

Referring to FIG. 1, a conduit 1 houses a fan 2 which comprises a rotor 3, having blades 4, and a stator 5, having vanes 6, the rotor and stator being mounted on a drive shaft 7 which drives the rotor 3.

The pure sound of the fan 2 is at a frequency proportional on the one hand to the speed of rotation of the rotor 3 and on the other to the number of blades 4.

A weak peripheral flow is allowed into a zone 8 around the periphery of the rotor blades 4, this flow having been drawn off upstream of the rotor from a zone 10.

Preferably, the peripheral flow is admitted in pulsating manner at a frequency proportional to the product of the rotary speed of the rotor and the number of blades thereof.

The admission of the peripheral flow to the zone 8 provides i) for stabilisation of the flow around the blades 4, and for ii) creation of secondary acoustic forces which act as anti-sound forces, that is, they create an active acoustic absorption of the pure sound at siren frequency, these anti-sound forces being disposed in the zone 8 and also in the zone 10.

At least one pipe 9, is used to convey weak peripheral flow the intake 11 of which pipe 9 is in the zone 10 upstream of the rotor 3, and the exit 12 of which pipe 9 discharges into the zone 8. The arrow *f* indicates the flow direction of medium drawn from the zone 10 and terminating at the zone 8.

Several pipes 9 may be provided, and inlets 11*a* and 11*b* of two other pipes are shown. The pipe or pipes 9 constitute branches of the main flow (indicated by the arrow F) and drawn off medium upstream of the rotor 3, delivering it to the zone 8 at the rotor.

Attenuation may be improved by providing a flap 13, indicated by the dashed line, which flap may have a folded-back part 14 as indicated by the dotted line. The flap 13 can collect and direct towards the pipe 9 part of the medium circulating upstream of the rotor 3. The purpose of the folded-back part is to direct part of the outside air towards the flap 13.

By virtue of the invention, it is possible to achieve an attenuation of the fundamental pure sound of the order of 10 to 25 Db, the overall noise being attenuated by the order of 10 Db without reducing the aerodynamic performance of the axial-flow fan in terms of flow or pressure.

Tests have shown that the invention makes it possible not only to reduce noise generated by an axial-flow fan but to increase the aerodynamic operating stability of the fan by modifying turbulence in the flow around the fan blades.

Figure 2:
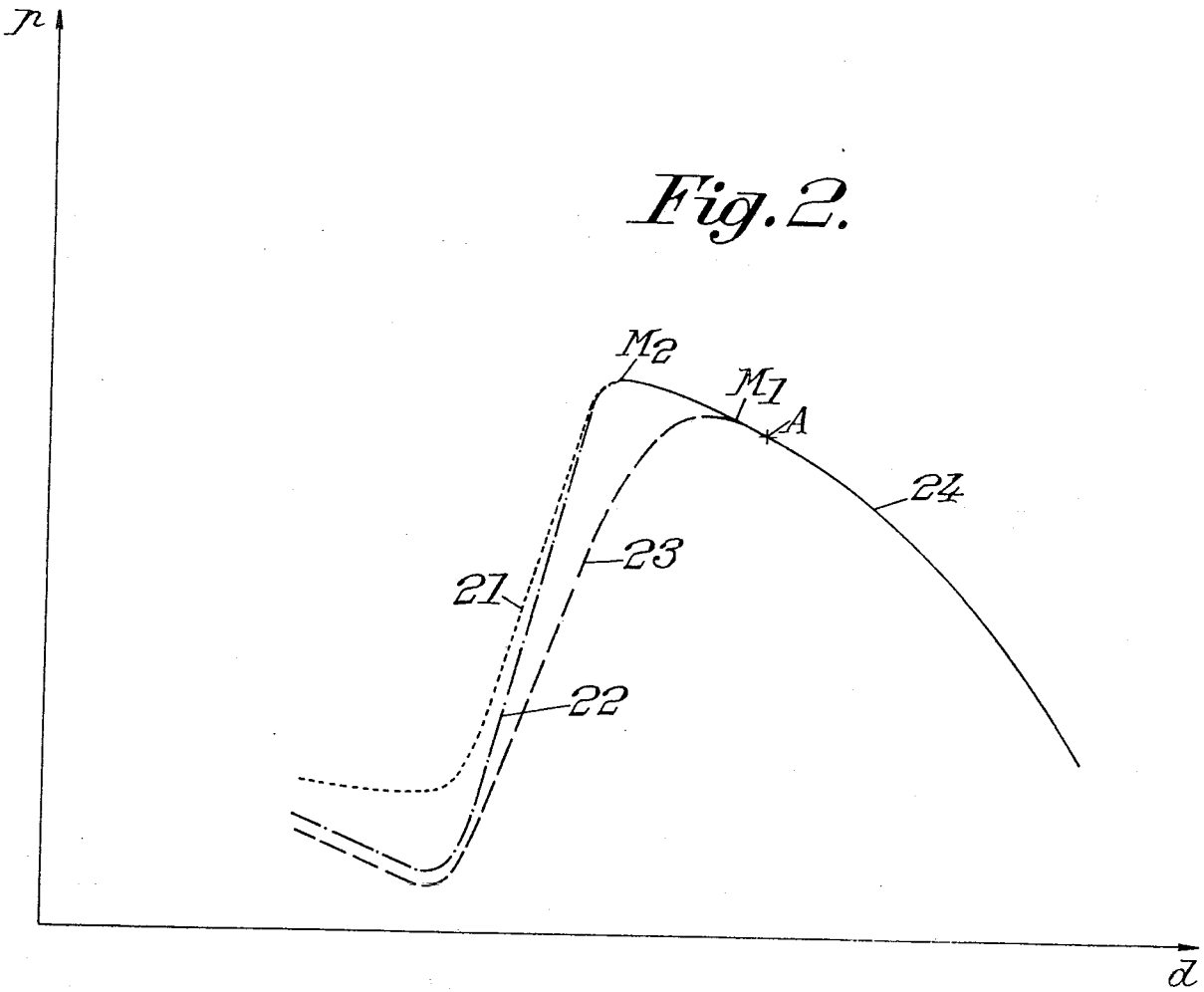
FIG. 2 is a graph showing pressure/flow characteristics of the axial-flow fan, of FIG. 1.

Thus, with the apparatus shown in FIG. 1, it has been possible to increase the zone of aerodynamic operating stability of the fan by, in a pressure/operating flow diagram of the fan, moving upwards and to the left the limit with effect from which operation of the fan becomes unstable when the rate of flow diminishes. Now referring to FIG. 2, the abscissa represents increasing rate of flow *d* while the ordinate indicates increasing pressure *p*, and three curves have been plotted, as follows:

i. a dotted line curve 21, showing the conditions when the pipe 9 is open;

ii. a dot-dash line 22, showing the conditions when the pipe is closed;

iii. a broken line curve 23, showing the conditions when no pipe is provided.

The three curves have a common portion shown by a solid line 24.

$M_1$ and $M_2$ represent the limits of stable operation (to the left of $M_1$ or $M_2$, operation is unstable), respectively in the case of a known fan without a pipe 9 and in the case of a fan with a pipe 9.

When the normal operating point A (in the case of the known fan without a pipe 9) is near the maximum, it will be appreciated that the displacement of the maximum from $M_1$ to $M_2$ constitutes an improvement and permits of more stable operation of the fan.

In relation to the known devices described in the preamble, the results obtained are improved from the points of view of acoustic operating stability and economy of means employed, while there is little or no loss from the aerodynamic efficiency point of view, which is not the case with the known devices.

The invention can be applied to an aircraft jet propulsion unit, to an industrial fan, for example as used in electric power stations, and to air-conditioning apparatus.

We claim:

1. In an axial-flow fan comprising a fan casing and a rotor having blades, said rotor being oriented to blow flow medium through the casing from upstream to downstream, said casing having a flow zone upstream of said rotor and a second zone at the periphery of said blades of said rotor, the improvement comprising at least one pipe having an intake and an outlet, said intake of said at least one pipe communicating with said flow zone and said outlet from said at least one pipe communicating with said second zone such that during operation of said rotor, said at least one pipe is drawing off flow medium from said flow zone and passing the drawn off medium to said second zone.

2. An axial-flow fan according to claim 1, further comprising at least one flap supported by said casing, said intake of each of said at least one pipe in said flow zone is associated with a respective said flap, each said flap communicating with said intake of the respective said pipe and being supported by said casing downstream of that said intake and said flap being inclined inwardly from said casing and upstream through said casing and said flap being in said flow zone, each said flap operating to direct some of the flow medium to its respective said pipe.

3. An axial-flow fan according to claim 2, wherein each said flap includes an outwardly inclined portion located upstream of and attached to the upstream end of said flap and inclined outwardly of said casing upstream thereof, said outwardly inclined flap portion operating to convey ambient air to its said flap.

* * * * *